US009278563B2

(12) United States Patent
Suzuki et al.

(10) Patent No.: US 9,278,563 B2
(45) Date of Patent: Mar. 8, 2016

(54) LIQUID EJECTING APPARATUS

(71) Applicant: SEIKO EPSON CORPORATION, Tokyo (JP)

(72) Inventors: Nobutaka Suzuki, Shiojiri (JP); Yasunori Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/420,631

(22) PCT Filed: Aug. 6, 2013

(86) PCT No.: PCT/JP2013/004739

§ 371 (c)(1),
(2) Date: Feb. 9, 2015

(87) PCT Pub. No.: WO2014/024472

PCT Pub. Date: Feb. 13, 2014

(65) Prior Publication Data

US 2015/0217585 A1 Aug. 6, 2015

(30) Foreign Application Priority Data

Aug. 10, 2012 (JP) ..... 2012-178148

(51) Int. Cl.
*B41J 25/00* (2006.01)
*B41J 2/175* (2006.01)

(52) U.S. Cl.
CPC ..... *B41J 25/006* (2013.01); *B41J 2/175* (2013.01); *B41J 2/17509* (2013.01)

(58) Field of Classification Search
CPC .... B41J 2/175; B41J 2/17509; B41J 2/17513; B41J 2/1752; B41J 2/17553; B41J 2/17596; B41J 2202/20
USPC ..... 347/84–86, 39
See application file for complete search history.

(56) References Cited

U.S. PATENT DOCUMENTS

| | | | | |
|---|---|---|---|---|
| 2003/0076391 | A1 | 4/2003 | Wilson et al. | |
| 2005/0024449 | A1 * | 2/2005 | Shiho et al. | 347/85 |
| 2007/0176984 | A1 * | 8/2007 | Seshimo | 347/85 |

FOREIGN PATENT DOCUMENTS

| | | |
|---|---|---|
| DE | 19923291 | 11/2000 |
| JP | 10-226084 | 8/1998 |
| JP | 2003-127427 | 5/2003 |
| JP | 2003-211700 | 7/2003 |
| JP | 2012-061624 | 3/2012 |
| JP | 2012-148511 | 8/2012 |

OTHER PUBLICATIONS

PCT/JP2013/004739, International Search Report dated Sep. 10, 2013. (10 pages).

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid ejecting apparatus capable of supplying liquid stably and continuously through a liquid supplying tube which performs a following deformation in accordance with a movement of a carriage embedded with a liquid ejecting head, while achieving compactness of a main body of the apparatus. The liquid ejecting apparatus includes a liquid ejecting head capable of ejecting ink onto a sheet; a carriage capable of reciprocating inside a main body case in a state of being embedded with the liquid ejecting head and an adaptor capable of supplying ink to the liquid ejecting head; and an ink supplying tube which performs a following deformation in the main body case in accordance with the reciprocation of the carriage in a state of being led out to be able to supply ink from an ink tank at an upstream side, disposed outside a movement range of the carriage, to the adaptor at a downstream side.

9 Claims, 6 Drawing Sheets

LIQUID EJECTING APPARATUS

TECHNICAL FIELD

The present invention relates to a liquid ejecting apparatus which ejects liquid supplied using a liquid supply tube.

BACKGROUND ART

In the related art, as a type of a liquid ejecting apparatus which ejects liquid toward a target, an ink jet printer is widely known. As such a printer, there is a so-called on-carry type printer in which a plurality of ink cartridges which accommodate ink, and a liquid ejecting head which ejects ink supplied from each ink cartridge onto a sheet are installed on a carriage which can perform reciprocating movement.

On the other hand, in recent years, a printer which can perform mass printing by being provided with an ink tank with a large capacity at the outside of a main body of the printer, and continuously providing ink to a liquid ejecting head in the main body of the printer through an ink supplying tube from the ink tank, not supplying ink from an ink cartridge which is installed on such a carriage has been developed (for example, PTL 1).

CITATION LIST

Patent Literature

PTL 1: JP-A-2012-61624

SUMMARY OF INVENTION

Technical Problem

Meanwhile, in such a printer, a plurality of ink supplying tubes which deform along with a movement of a carriage on which a liquid ejecting head is installed are pulled around so as to be horizontally aligned in a direction which intersects a movement direction of the carriage. For this reason, a space for pulling around an ink supplying tube in which the plurality of ink supplying tubes can be arranged in a horizontally aligned state should be secured, and accordingly, it is difficult to make the main body of the printer compact. On the other hand, in a case of a use situation of solely printing documents in which only ink of a specific color such as black ink is intensively used, for example, it is not necessary for an ink supplying tube corresponding to each color with a low frequency of use, except for the specific color, to be pulled around at all.

In addition, in a liquid ejecting apparatus in which a liquid ejecting head ejects liquid which is supplied from a liquid tank through a liquid supply tube which performs follow-up deformation along with a movement of a carriage on which the liquid ejecting head is installed, such a situation becomes almost common without being limited to the above-described ink jet printer.

The present invention has been made in view of the above described situation, and an object thereof is to provide a liquid ejecting apparatus which can stably and continuously supply liquid through a liquid supply tube which performs follow-up deformation along with a movement of a carriage on which a liquid ejecting head is installed while making an apparatus main body compact.

Solution to Problem

Hereinafter, means for solving the above described problem, and an operational effect thereof will be described.

A liquid ejecting apparatus includes a liquid ejecting head which can eject liquid onto a target; a carriage which can perform a reciprocating movement in an apparatus main body in a state of having the liquid ejecting head installed thereon, and an adaptor which can supply the liquid to the liquid ejecting head; and one liquid supply tube which performs follow-up deformation in the apparatus main body along with the reciprocating movement of the carriage in a state of being pulled around so as to supply the liquid from a liquid tank which becomes an upstream side arranged at an outside of a movement range of the carriage to the adaptor which becomes a downstream side.

According to the configuration, since it is sufficient to provide a space for pulling only one liquid ejecting tube around in the main body of the liquid ejecting apparatus, it is possible to make the apparatus main body compact compared to a case in which a plurality of ink supplying tubes are pulled around in a state of being horizontally aligned. Accordingly, it is possible to stably and continuously supply liquid through the liquid supply tube which performs follow-up deformation along with a movement of the carriage on which the liquid ejecting head is installed while making the apparatus main body compact.

In the liquid ejecting apparatus, the liquid supply tube may be configured by including a first extending portion which is in a state of extending along a movement direction of the carriage in the apparatus main body from the liquid tank side; a curved portion which is in a curved state which is reversed in a vertical direction by being stretched out to the downstream side from the first extending portion; a second extending portion which is in a state of extending along the movement direction of the carriage in the apparatus main body by being stretched out to the downstream side from the curved portion; and a connection unit which is connected to the adaptor by being stretched out to the downstream side from the second extending portion, in which the first extending portion and the second extending portion may be pulled around so that at least partial portions thereof overlap with each other in the vertical direction.

According to the configuration, since the liquid supply tube is configured so that at least a part of the second extending portion overlaps with the first extending portion in the vertical direction along with a movement of the carriage, it is possible to further reliably make the apparatus main body compact in the movement direction of the carriage, and in a forward-backward direction which intersects the vertical direction.

In the liquid ejecting apparatus, a connection portion of the adaptor to the liquid supply tube may be installed at a position which is separated from an end portion of the carriage which is a side opposite to a side on which the liquid tank is arranged, in the movement direction of the carriage.

According to the configuration, when the carriage is located at a position at which the carriage is separated farthest from the liquid tank in a reciprocating movement range of the carriage, it is possible to make a protruding amount of the liquid supply tube (when there is a curved portion, the curved portion) which protrudes from an end portion of the carriage in the movement direction of the carriage small. In this manner, it is possible to make the apparatus main body in the movement direction of the carriage compact by making a space for securing the protruding amount of the liquid supply tube small.

In the liquid ejecting apparatus, a protective plate which is additionally provided on the outer side of the liquid supply tube which performs follow-up deformation, and performs follow-up deformation along with the reciprocating movement of the carriage together with the liquid supply tube may be further provided.

According to the configuration, it is possible to prevent the liquid supply tube which performs follow-up deformation along with the reciprocating movement of the carriage from coming into contact with other components in the apparatus main body by providing the protective plate.

In the liquid ejecting apparatus, the protective plate may include a regulation unit which regulates a movement of the liquid supply tube in a direction intersecting an extending direction of the liquid supply tube.

According to the configuration, the regulation unit of the protective plate regulates a movement of the liquid supply tube in the direction intersecting the extending direction of the liquid supply tube when the liquid supply tube performs follow-up deformation along with the reciprocating movement of the carriage. In this manner, it is possible to prevent the liquid supply tube from coming into contact with other components in the apparatus main body by moving in the direction intersecting the extending direction.

In the liquid ejecting apparatus, a plurality of liquid supply tubes are connected with each other through a joint which connects tubes therebetween.

According to the configuration, it is possible to individually exchange the liquid supply tubes on the upstream side and the downstream side which are connected through the joint. In this manner, it is possible to improve maintainability related to an exchange of the liquid supply tube.

In the liquid ejecting apparatus, a cover which is mounted on the carriage from a direction intersecting a vertical direction may be further provided in order to cover the adaptor which is installed on the carriage from above.

According to the configuration, it is possible to make a mounting failure of the cover be easily recognized by a user who views the liquid ejecting apparatus from above in general, when the cover is mounted in a direction intersecting the vertical direction, compared to a case in which the cover is mounted in the vertical direction.

In the liquid ejecting apparatus, the cover may include a pressing unit which presses a connection unit so that a movement of the connection unit is regulated when the cover is mounted on the carriage.

According to the configuration, the pressing unit presses the connection unit of the liquid supply tube when the cover is mounted on the carriage, and regulates a movement thereof. Accordingly, for example, even when the liquid supply tube receives a force generated in the extending direction of the liquid supply tube due to follow-up deformation of the liquid supply tube which is performed along with the reciprocating movement of the carriage, it is possible to prevent the liquid supply tube from being pulled out from the adaptor.

DESCRIPTION OF EMBODIMENTS

Hereinafter, one embodiment of a multifunction peripheral which includes a recording apparatus as an example of a liquid ejecting apparatus will be described with reference to drawings.

Figure 1:
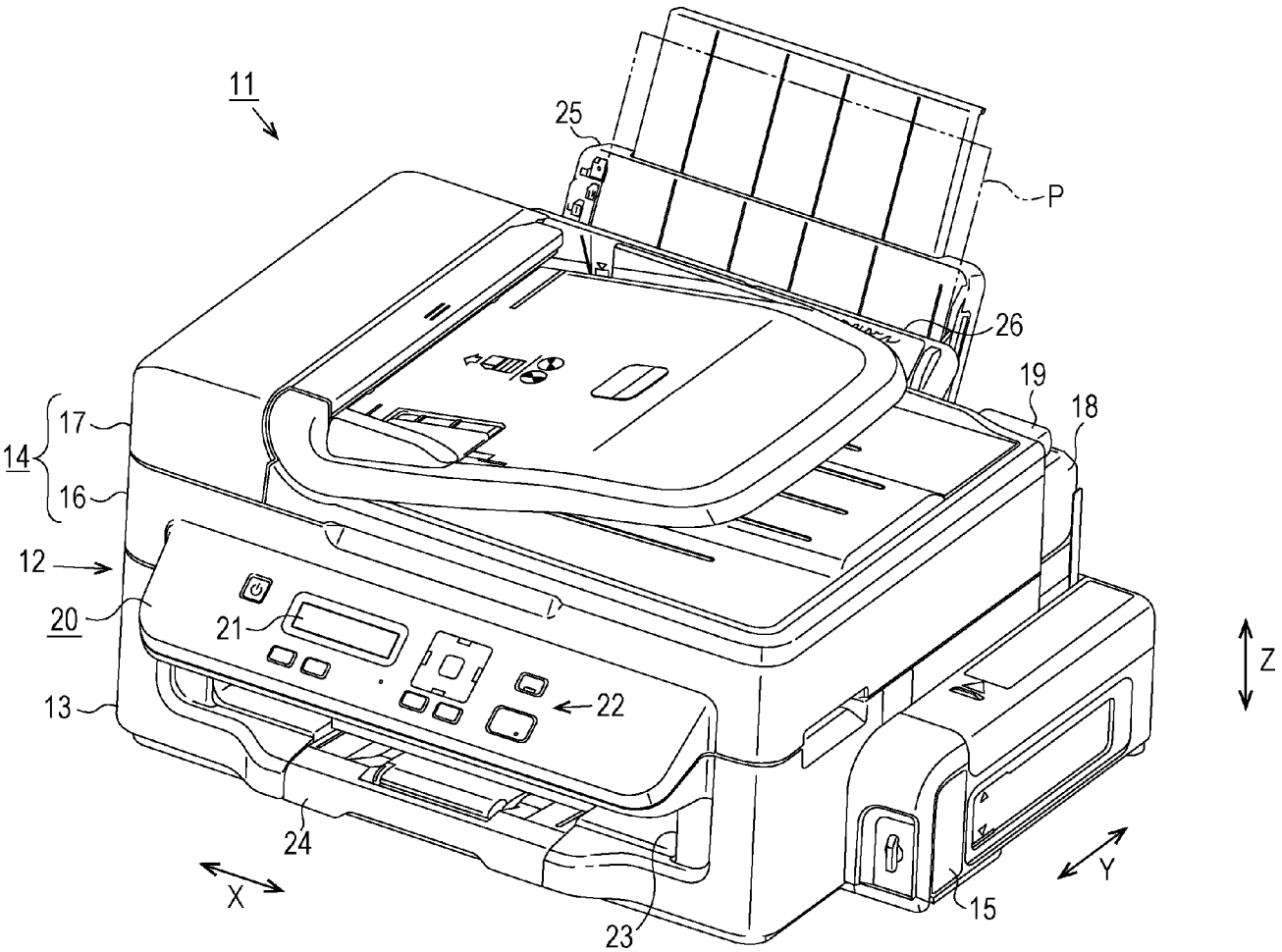
FIG. 1 is a perspective view of a multifunction peripheral according to one embodiment.

As illustrated in FIG. 1, a multifunction peripheral 11 includes a recording apparatus 12, a scanner unit 14 which is installed on a main body case 13 of the recording apparatus 12, and an ink tank 15 as an example of a liquid tank which is detachably mounted on one side face of the recording apparatus 12. In addition, in the specification, an antigravity direction is referred to as a higher direction, and a gravity direction is referred to as a lower direction. In addition, a direction which extends in the higher direction and lower direction is illustrated as a vertical direction Z.

The recording apparatus 12 can perform recording with respect to a sheet P which is an example of a target, and meanwhile, the scanner unit 14 can read an image, or the like, which is recorded on an original document. The scanner unit 14 includes a scanner main body unit 16 of which a part is rotatably connected to the main body case 13 of the recording apparatus 12, and a transport unit 17 which is arranged above the scanner main body unit 16. The scanner main body unit 16 is attached so as to be able to be displaced between a closed position at which the higher part of the main body case 13 is covered and an open position at which the higher part of the main body case 13 is open with respect to the recording apparatus 12, through a rotating mechanism 18 such as a hinge which is provided on one end side thereof. In addition, the transport unit 17 is attached so as to be displaced between a covered position and an open position of the higher part of the scanner main body unit 16 with respect to the scanner main body unit 16 through a rotation mechanism 19 such as a hinge which is provided on one end side thereof.

In addition, in the following description, in the multifunction peripheral 11, a side on which the rotating mechanisms 18 and 19 are provided is referred to as a rear side or a rear surface side, and a side opposite thereto is referred to as a front side. In addition, a direction of moving back and forth is illustrated as a forward-backward direction Y direction.

An operation panel 20 is arranged on the front face side of the multifunction peripheral 11. The operation panel 20 includes a display unit (for example, liquid crystal display) 21 for displaying a menu screen, or the like, and various operation buttons 22 which are provided around the display unit 21.

In the recording apparatus 12, a sheet discharging port 23 for discharging a sheet P from the main body case 13 is open at a position which is the lower part of the operation panel 20. In addition, a sheet discharging stand 24 which can be drawn out is accommodated on the lower part of the sheet discharging port 23 in the recording apparatus 12. In addition, a medium support body 25 which can be drawn out, and is in a shape of an approximately rectangular plate on which a plurality of sheets P can be loaded is attached to the rear surface side of the recording apparatus 12.

In addition, a transport mechanism which is not illustrated is accommodated in the main body case 13. In addition, when a sheet p is guided into the main body case 13 through a sheet feeding port 26, the sheet p is transported to the front side using the transport mechanism in the main body case 13, and is discharged to the outside of the main body case 13 through the sheet discharging port 23. That is, the forward direction in the forward-backward direction Y is also a direction in which the sheet p is transported in the main body case 13. In addition, a direction which intersects (according to the embodiment, is orthogonal to) both the vertical direction Z and the forward-backward direction Y is set to the main scanning direction X.

Figure 2:
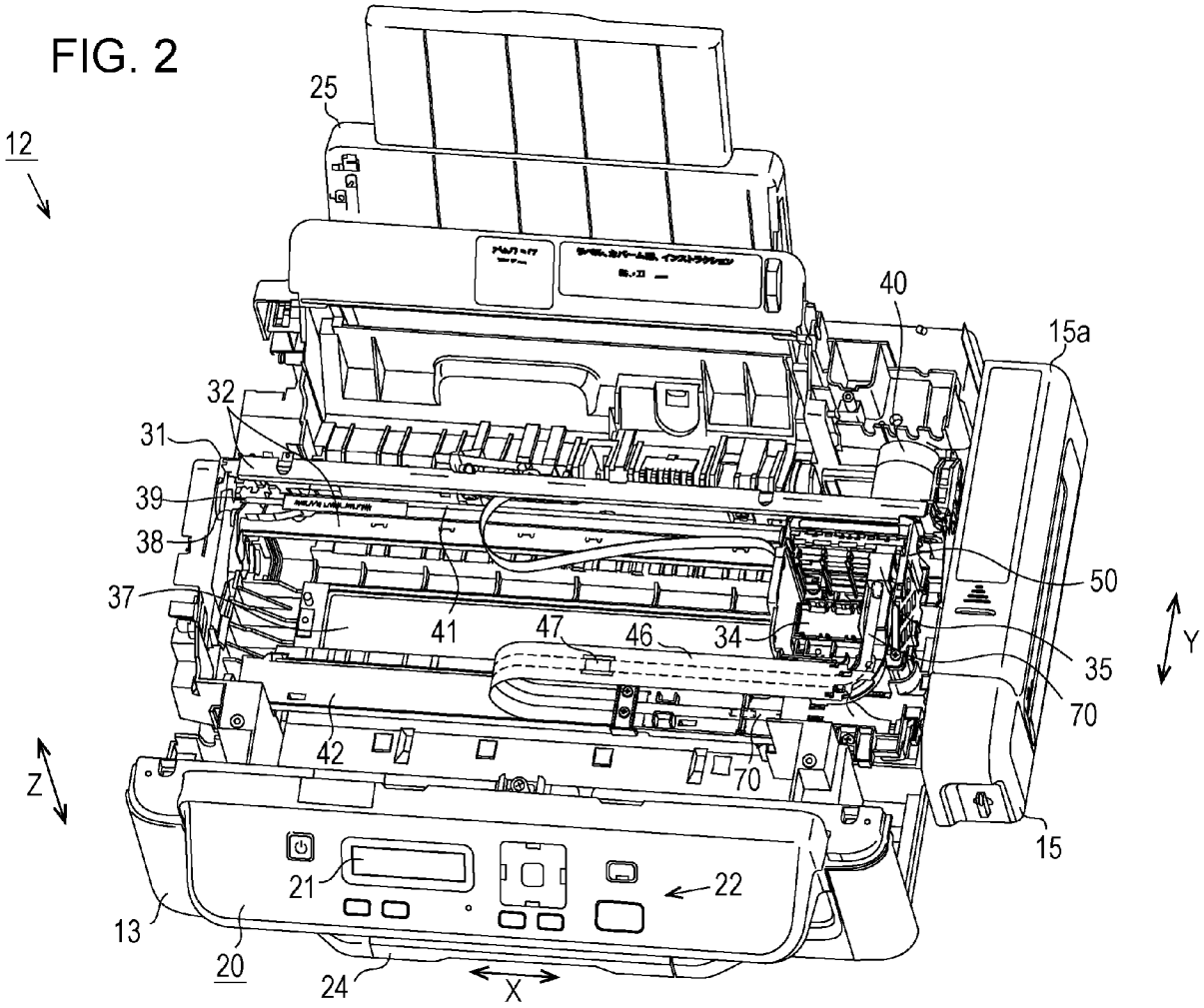
FIG. 2 is a perspective view which illustrates an internal structure of a recording apparatus.

As illustrated in FIG. 2, a strip plate-shaped guide frame 31 in which the main scanning direction X is the longitudinal direction, and the vertical direction Z is the transverse direction is provided in the main body case 13. A guide rail 32 which extends in the main scanning direction X is formed in the higher end portion and the lower end portion of the guide frame 31, when an edge portion of the higher side and an edge portion of the lower side of the guide frame 31 with a regular width which extends in the longitudinal direction are bent toward the front direction, respectively. In addition, in the guide rail 32, a carriage 50 is supported so as to reciprocate in a direction which extends in the longitudinal direction.

A liquid ejecting head 34 which can eject ink to a sheet P is held on the lower face side of the carriage 50. A plurality of liquid ejecting nozzles (not illustrated) open on the lower face side of the liquid ejecting head 34. Meanwhile, an adaptor 35 which can supply ink to the liquid ejecting head 34 is mounted on the carriage 50. The adaptor 35 is formed in approximately the same shape as an ink cartridge which is mounted on a so-called on carry-type printer which ejects ink supplied from an ink housing body which is mounted on the carriage 50. In addition, a connection tube portion 35*a* in a circular tube shape which protrudes to the front side is provided at a portion which is exposed to a spatial region on the upper part of the adaptor 35 in a state in which the carriage 50 is mounted, and an ink supplying tube 70 which can supply ink from the ink tank 15 to the connection tube portion 35*a* is connected to the portion. In addition, a support member 37 for supporting the sheet P on the lower part of the liquid ejecting head 34 is arranged at a base portion in the main body case 13 by setting the main scanning direction X as the longitudinal direction.

Pulleys 38 which form a pair so as to be aligned in the main scanning direction X (one pulley is not illustrated), and an endless timing belt 39 which is wound around both pulleys are arranged on the rear side of the carriage 50. A driving axis of a carriage motor 40 is attached to one pulley. In addition, when the carriage motor 40 is driven by switching between both normal and reverse directions, and when the timing belt 39 is normally and reversely rotated, the carriage 50 performs a reciprocating movement in the main scanning direction X. In addition, recording is performed when the liquid ejecting head 34 which moves along with the carriage 50 ejects ink droplets to the sheet P which is supported by the support member 37. In addition, a linear encoder 41 for detecting a position of the carriage 50 in the main scanning direction X is provided so as to extend on a movement path of the carriage 50 on the rear side of the carriage 50. In addition, a position which becomes the lower part of the carriage 50 in FIG. 2 is a home position at which maintenance of the liquid ejecting head 34 is performed.

Subsequently, a specific configuration of the carriage 50 will be described.

Figure 3:
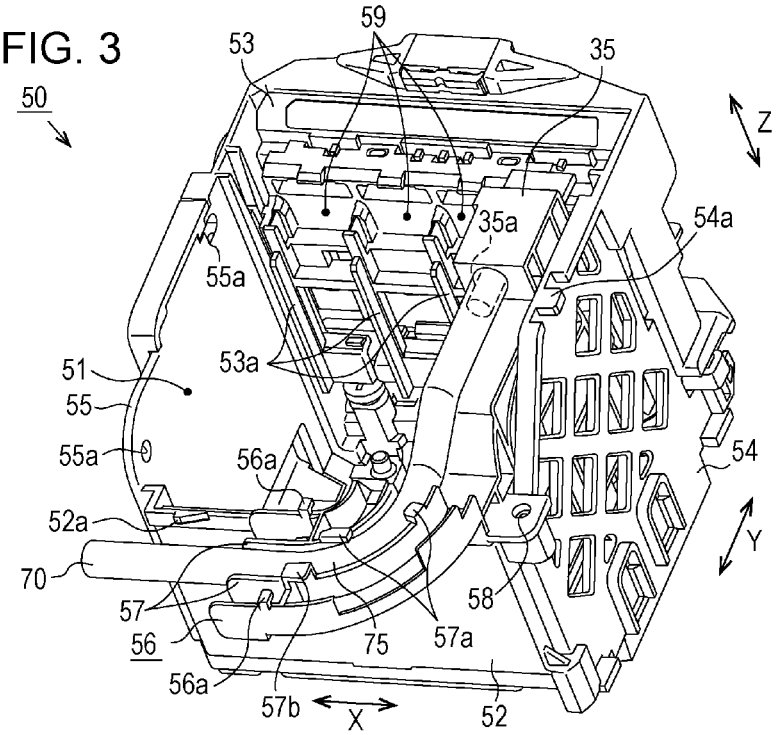
FIG. 3 is a perspective view of a carriage when a cover is not mounted.

As illustrated in FIG. 3, the carriage 50 has a box shape with an opening 51 in the higher direction in the vertical direction Z, includes a first side wall 52 in the forward-backward direction Y, and a second side wall 53 on the rear side in the forward-backward direction Y. In addition, the carriage 50 includes a third side wall 54 which becomes a side wall on the ink tank 15 side, and a fourth side wall 55 which becomes an end portion (side wall) on the opposite side to the side on which the ink tank 15 is arranged in the main scanning direction X.

As illustrated in FIG. 3, at the higher end portion of the first side wall 52, a first guide unit 56 which has a horizontal band shape, and can support the ink supplying tube 70 of which a downstream end is connected to the connection tube portion 35*a* of the adaptor 35 is formed so as to describe an arc toward the fourth side wall 55 in the main scanning direction X from the front side in the forward-backward direction Y. In addition, in the first guide unit 56, a pair of guide walls 57 which can interpose the ink supplying tube 70 between both sides in the horizontal direction is formed so as to face each other along the extending direction of the first guide unit 56.

In addition, in a higher end of each guide wall 57, a hook-shaped tube locking unit 57*a* which protrudes to a higher end of the guide wall 57 on the other side which faces thereto is formed. In addition, in a higher end of the guide wall 57 on the outer side which forms a larger arc shape than that of the guide wall 57 on the other side, in both guide walls 57, a hook-shaped cover locking unit 57*b* which protrudes to the outer side thereof is formed. In addition, at a portion extending in the main scanning direction X of the first guide unit 56, a plurality of protective plate locking units 56*a* (two in embodiment) which form a hook shape in the rear direction are formed on the higher end thereof.

In addition, the height of the first side wall 52 in the vertical direction Z is formed so as to be low compared to other side walls 53 to 55. For this reason, the first guide unit 56 which extends from the higher end portion of the first side wall 52 is also provided at a position which is lower than other side walls 53 to 55. In addition, the cover locking unit 52*a* which has a right-angled triangle shape when planarly viewed is formed in a protruding manner in the front direction in the position adjacent to the fourth side wall 55 which is an higher end portion of the first side wall 52.

A cover locking unit 54*a* which protrudes in the rightward direction which becomes the ink tank 15 side is formed in the third side wall 54 in a higher end portion at an approximately center position in the forward-backward direction Y thereof. In addition, a screw hole 58 is formed in a direction which goes along the vertical direction Z in a higher end portion at a corner portion of the carriage 50 which is formed by the third side wall 54 and the first side wall 52.

A plurality of (two in embodiment) positioning holes 55*a* are formed in the fourth side wall 55 in a higher end portion thereof in a direction which goes along the main scanning direction X in a penetrating manner. Each of the positioning holes 55*a* is formed at a position which is close to the first side wall 52, and the second side wall 53, in the higher end portion on the fourth side wall 55.

In addition, a plurality of (four in embodiment) mounting units 59 on which the adaptor 35 can be mounted are arranged in line in the main scanning direction X in a region of the carriage 50 in which the carriage is surrounded by each of the side walls 52 to 54. In addition, each of the mounting units 59 is divided by an upright rib 53*a* which is erected toward the front side in the forward-backward direction Y from the second side wall 53 of the carriage 50. In addition, according to the embodiment, the adaptor 35 is mounted on the mounting unit 59 which is closest to the ink tank 15 side (right side in FIG. 3) among each of mounting units 59 which are divided by the upright ribs 53*a*. Accordingly, in FIG. 3, the mounting unit 59 which is located on the rightmost side among four mounting units 59 is in a hidden state when the adaptor 35 is mounted.

Subsequently, a cover 60 which covers the opening 51 of the carriage 50 will be described.

Figure 6:
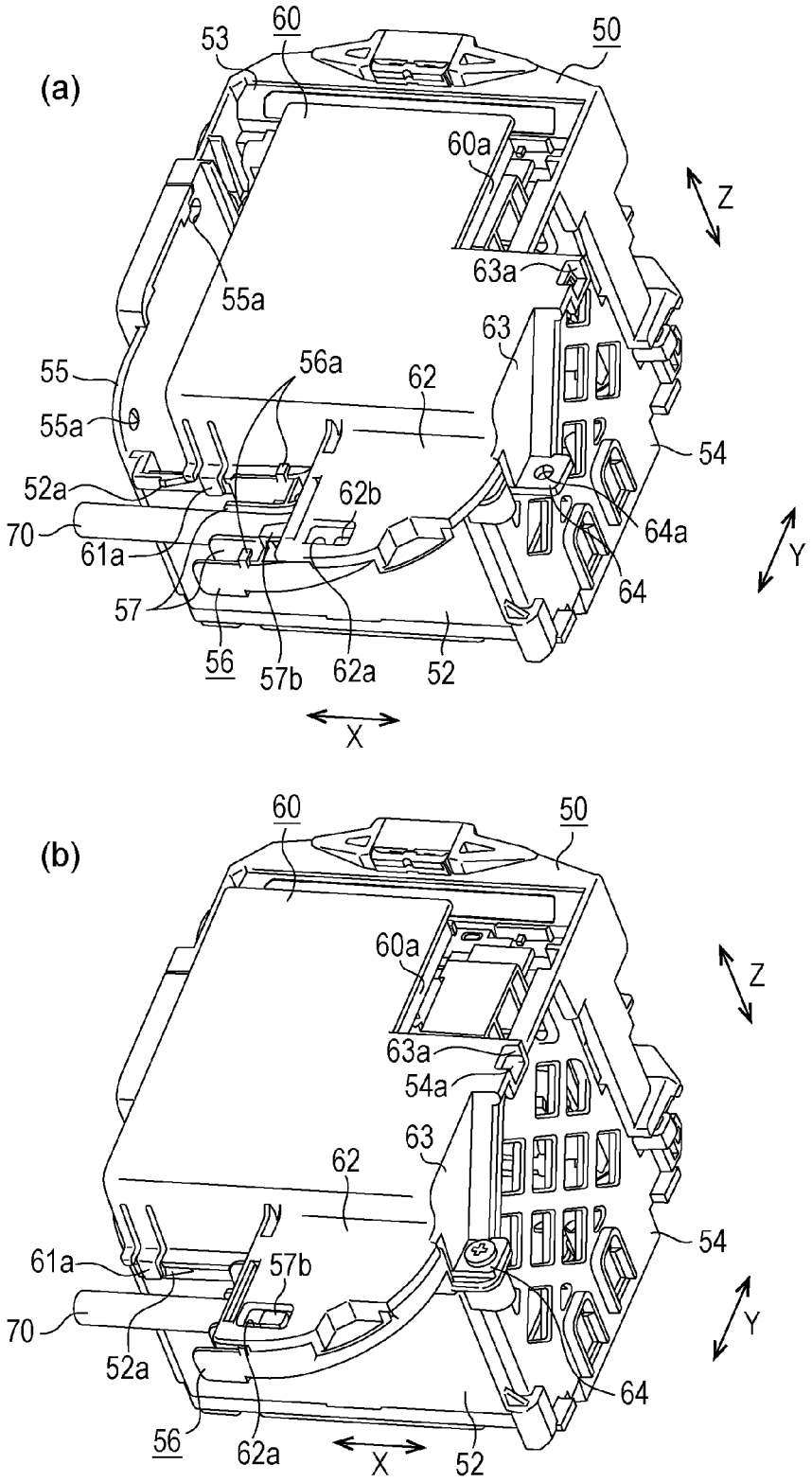
FIG. 6 is a diagram which illustrates a state in which the cover is mounted on the carriage, FIG. 6(*a*) is a perspective view in the middle of mounting, and FIG. 6(*b*) is a perspective view when the mounting is completed.

In addition, each direction such as the forward-backward direction, the horizontal direction, and the vertical direction of the cover 60 in the following description is set to a direction in a posture of the cover when being mounted on the carriage 50 as illustrated in FIGS. 6(*a*) and 6(*b*).

Figure 4:
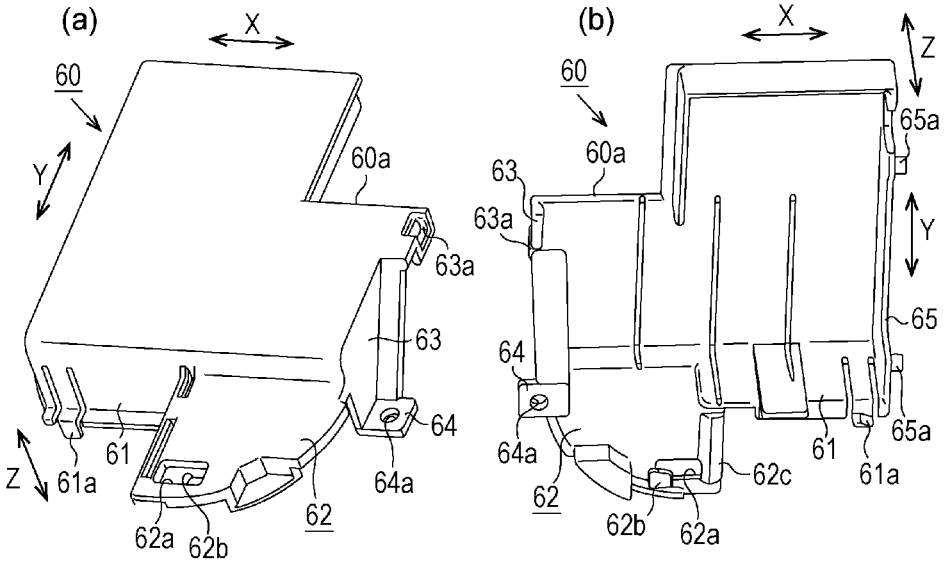
FIG. 4(*a*) is a perspective view when the cover is viewed obliquely from above, and FIG. 4(*b*) is a perspective view when the cover is viewed obliquely from below.

As illustrated in FIG. 4(*a*), the cover 60 forms a shape corresponding to the opening 51 of the carriage 50 when planarly viewed, and a rectangular notch 60*a* is formed at a corner portion on the right rear side thereof. The notch 60*a* is formed at a position corresponding to the corner portion on the right rear side which is formed by the second side wall 53 and the third side wall 54 of the carriage 50 when the cover 60 is mounted on the opening 51 of the carriage 50. In addition, a side wall 61 which is in a pendulous state when being mounted on the carriage 50, and a covering lid unit 62 which has in an approximate fan-shape when planarly viewed are formed at a side portion on the front side which is the opposite side to the side in the forward-backward direction Y on which the notch 60*a* is formed in the cover 60. The covering lid unit 62 is provided so that the first guide unit 56 is covered from the higher side at a position corresponding to the first guide unit 56 of the carriage 50, when the cover 60 is mounted on the carriage 50.

In the covering lid unit 62 of the cover 60, a hole portion 62*a* is formed in a direction which goes along the vertical direction Z, and a hook-shaped unit for locking 62*b* is provided on the lower side of the hole portion 62*a* so as to close a part of the hole portion 62*a*. In addition, the unit for locking 62*b* can be engaged with the hook-shaped cover locking unit 57*b* of the carriage 50. In addition, a unit for locking 61*a* is formed in an end portion on the side opposite to the side on which the covering lid unit 62 is formed in the main scanning direction X in the side wall 61 on the front side of the cover 60 by providing two grooves on the side wall 61. The unit for locking 61*a* can be engaged with the cover locking unit 52*a* of the carriage 50 using own elastic deformation.

In addition, a side wall 63 which is in an approximate triangular shape when viewed from the side is formed on the right side portion of the cover 60. In addition, a notch-shaped unit for locking 63*a* is formed in a higher end portion of the side wall 63. The unit for locking 63*a* can be engaged with the cover locking unit 54*a* of the carriage 50. In addition, a plate portion 64 which extends in a direction intersecting the side wall 63 is formed in a lower end portion of the right side wall 63 of the cover 60, and a through hole 64*a* is formed on the plate portion 64 in a direction which goes along the vertical direction Z. The through hole 64*a* is formed so as to correspond to the screw hole 58 of the carriage when the cover 60 is mounted on the carriage 50 in the vertical direction Z.

As illustrated in FIG. 4(*b*), a plurality of (two in embodiment) positioning convex portions 65*a* which protrude toward a direction which goes along the main scanning direction X are formed on a side wall 65 which is formed on a side portion which becomes the left side (right side in FIG. 4(*b*)), when the cover is mounted on the carriage 50 in a perspective view from the rear surface of the cover 60. The positioning convex portion 65*a* is provided so as to correspond to the positioning hole 55*a* which is formed in the carriage 50.

In addition, on the rear surface side of the cover 60, a pressing unit 62*c* which protrudes to the lower part in the vertical direction Z is formed in the covering lid unit 62 so as to extend in the forward-backward direction Y. The pressing unit 62*c* presses a portion at which the cover 60 is arranged on the first guide unit 56 in the ink supplying tube 70, when being mounted on the carriage 50, that is, a connection unit 75 (refer to FIG. 3) which is arranged in a state of being bent by a predetermined length from the downstream end which is connected to the connection tube portion 35*a* of the adaptor 35, and regulates a movement thereof.

Subsequently, a configuration related to an ink supply system in which ink is supplied from the ink tank 15 which is arranged on the outer side of the main body case 13 to the liquid ejecting head 34 will be described in detail.

Figure 5:
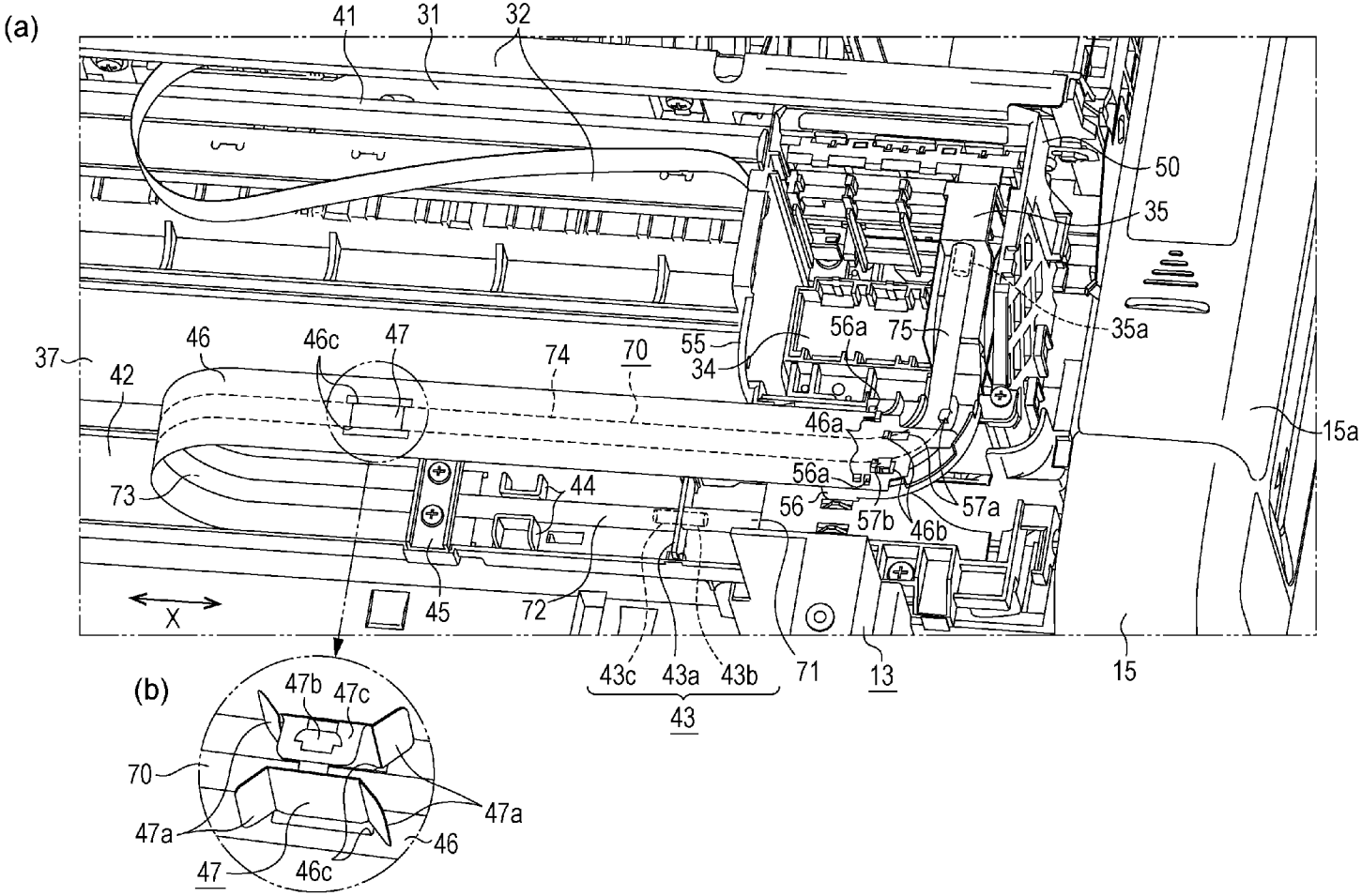
FIG. 5 is a diagram which illustrates an internal configuration of the recording apparatus, FIG. 5(*a*) is a partially enlarged view of FIG. 2, and FIG. 5(*b*) is a perspective view of a regulation unit.

As illustrated in FIG. 5(*a*), the ink tank 15 which is the furthest upstream side in the ink supply system is detachably mounted on one side surface (right side in FIG. 2) in the main scanning direction X of the main body case 13. A slide cover 15*a* is provided on the higher face of the ink tank 15, and it is possible to supply ink into the ink tank 15 through an ink inlet (not illustrated) which appears when the slide cover 15*a* is in an open state.

In addition, the ink supplying tube 70 which supplies ink from the ink tank 15 on the upstream side to the adaptor 35 on the downstream side is arranged in the main body case 13. First, a portion of the ink supplying tube 70 on the furthest upstream side becomes an introduction unit 71 which is introduced into the main body case 13 from the ink tank 15. The introduction unit 71 is mounted on a second guide unit 42 which extends in the main scanning direction X on the higher side of the sheet discharging port 23 (refer to FIG. 1) in the main body case 13, and is fixed so as not to move and be deformed. In addition, an end portion of the introduction unit 71 on the upstream side is connected to the ink tank 15; however, in contrast to this, an end portion of the introduction unit 71 on the downstream side is connected to a joint unit 43 as an example of a joint which is arranged on the second guide unit 42 by being fixed.

The joint unit 43 includes a unit for fixing 43*a* which extends in a direction intersecting the longitudinal direction of the second guide unit 42, and is fixed to the second guide unit 42 through both end portions of the unit for fixing 43*a*. In addition, connection ports 43*b* and 43*c* which can connect the ink supplying tube 70 are formed in a protruding manner toward both directions in the main scanning direction X in the unit for fixing 43*a* of the joint unit 43. That is, the connection port 43*b* which faces the upstream side is connected to a downstream end of the introduction unit 71 of the ink supplying tube 70, and on the other hand, the connection port 43*c* which faces the downstream side is connected to an upstream side end of a first extending portion 72 which extends to the downstream side in the main body case 13. In this way, the joint unit 43 connects the introduction unit 71 and the first extending portion 72 to each other in such a manner that the ink can flow therethrough. In addition, since the introduction unit 71 and the first extending portion 72 are detachably connected to the joint unit 43, the ink supplying tube 70 on the upstream side and downstream side which are formed through the joint unit 43 can be individually exchanged, respectively.

The first extending portion 72 is mounted on the second guide unit 42 in a state of extending along the main scanning direction X on the downstream side of the joint unit 43 (left side in figure). In addition, the first extending portion 72 is fixed so as not to move using a rib 44 and an interposing member 45 at a position which is slightly closer to the ink tank 15 than a center position in the main scanning direction X of the second guide unit 42. The ribs 44 form a pair in the forward-backward direction Y intersecting the longitudinal direction of the second guide unit 42, and are formed toward a higher direction in a protruding manner. In addition, the pair of ribs 44 interposes the first extending portion 72 therebetween in a direction which goes along the forward-backward direction Y. Meanwhile, the interposing member 45 fixes the second guide unit 42 using a screw in a state in which the first extending portion 72 is interposed in a direction which goes along the vertical direction Z along with the second guide unit 42. In this manner, the first extending portion 72 is fixed so as not to move with respect to the second guide unit 42 using the rib 44 and the interposing member 45.

A curved portion 73 at which the extending direction of the first extending portion 72 is reversed while being bent in the vertical direction Z is provided on the downstream side of the first extending portion 72. The curved portion 73 is maintained in a state of being curved using elasticity of the ink supplying tube 70.

A second extending portion in a state of extending in the main scanning direction X is provided on the downstream side of the curved portion 73. Here, the first extending portion 72 and the second extending portion 74 are provided so that at least a part (all in the embodiment) thereof overlaps with each other in the vertical direction Z.

The connection unit 75 which bends the extending direction of the second extending portion 74 to the rear side, and connects an end portion on the downstream side to the adaptor 35 which is mounted on the carriage 50 is provided on the downstream side of the second extending portion 74. That is, the connection unit 75 which is also the furthest downstream portion of the ink supplying tube 70 is connected to the connection tube portion 35*a* of which the downstream end protrudes to the front side from the adaptor 35, while being guided by the first guide unit 56. In addition, the connection unit 75 is fixed to the first guide unit 56 when being locked to a tube locking unit 57*a* of the first guide unit 56. At this time, the connection unit 75 is in a simple arrangement state in which the extending direction is simply curved by a predetermined angle (90° in embodiment). In addition, the adaptor 35 according to the embodiment is mounted on the mounting unit 59 which is closest to the ink tank 15 side. For this reason, the connection tube portion 35*a* of the adaptor 35 which is connected to the ink supplying tube 70 is located at a position which is separated from the fourth side wall 55 which is an end portion which becomes the side opposite to the side on which the ink tank 15 is arranged in the movement direction of the carriage 50 (main scanning direction X).

In addition, all of the above-described introduction unit 71, the first extending portion 72, the curved portion 73, the second extending portion 74, and the connection unit 75 are flow path portions which configure the ink supplying tube 70. In addition, through the ink supplying tube 70 which is configured in this manner, it is possible to stably and continuously supply ink from the ink tank 15 which is mounted on the outer side of the main body case 13 to the adaptor 35 which is mounted on the carriage 50. In addition, since the ink supplying tube 70 is configured of a material which elastically deforms, the ink supplying tube 70 can perform follow-up deformation according to a reciprocating movement of the carriage 50.

In addition, a twist prevention line (not illustrated) is formed on the circumferential surface of the ink supplying tube 70 along the extending direction. The twist prevention line is formed in order to prevent an occurrence of twisting in the ink supplying tube 70 when arranging the ink supplying tube 70 in the main body case 13.

As illustrated in FIG. 5(*a*), the protective plate 46 which performs follow-up deformation along with the ink supplying tube 70 is additionally provided on the outer side of the first extending portion 72, the curved portion 73, and the second extending portion 74 in the ink supplying tube 70 which performs follow-up deformation according to the reciprocating movement of the carriage 50. A plurality of units for locking 46*a* (two in embodiment), and a plurality of escape holes 46*b* (two in embodiment) are formed in the protective plate 46 at an end portion on the downstream side. The unit for locking 46*a* is provided corresponding to the protective plate locking unit 56*a* of the first guide unit 56 of the carriage 50, and the escape hole 46*b* is provided corresponding to a tube locking unit 57*a* and a cover locking unit 57*b*. In addition, the end portion on the downstream side of the protective plate 46 is fixed to the carriage 50 when the tube locking unit 57*a* and the cover locking unit 57*b* are inserted into the escape hole 46*b*, and the unit for locking 46*a* is locked to the protective plate locking unit 56*a*. Meanwhile, the end portion on the downstream side of the protective plate 46 is fixed to the second guide unit 42 and the interposing member 45 in a state of being interposed therebetween along with the first extending portion 72.

In addition, as illustrated in FIG. 5(*b*), a regulation unit 47 which regulates a movement of the ink supplying tube 70 in a direction intersecting the extending direction of the ink supplying tube 70 is provided on the protective plate 46. The regulation unit 47 has the illustrated form when being inserted into two slits 46*c* which are formed on the protective plate 46, and when a part thereof is folded thereafter. In addition, FIG. 5(*b*) is a diagram in which a region surrounded by a two-dot chained line circle in FIG. 5(*a*) is viewed from the rear side.

In FIG. 5(*b*), four faces which form an acute angle with respect to the extending direction of the ink supplying tube 70 become a fall out prevention unit 47*a* which suppresses falling out of the regulation unit 47 from the slit 46*c* of the protective plate 46. In addition, in FIG. 5(*b*), the regulation unit 47 is arranged so as to surround the circumference of the ink supplying tube 70 when an engaging male unit 47*b* and an engaging female unit 47*c* which are folded back from the near side and the far side toward the ink supplying tube 70 are engaged with each other. In addition, similarly to the protective plate 46, the regulation unit 47 is also configured of an elastic material, and the regulation unit 47 can be inserted into the slit 46*c*, or cause the engaging male unit 47*b* and the engaging female unit 47*c* to be engaged by deforming a part of the regulation unit 47. In addition, in FIG. 5(*a*), the regulation unit 47 regulates the second extending portion 74 in the ink supplying tube 70; however, since the regulation unit performs follow-up deformation (movement) along with the ink supplying tube 70 with respect to the carriage 50 which performs reciprocating movement, the regulation unit regulates the curved portion 73 or the first extending portion 72 according to a position of the carriage 50.

Subsequently, operations of the multifunction peripheral 11 will be described.

Meanwhile, the adaptor 35 is mounted on the mounting unit of the carriage 50, and then the cover 60 is mounted in order to cover the opening 51 of the carriage 50. First, a case in which the cover 60 is mounted on the carriage 50 will be described.

As illustrated in FIG. 6(*a*), when mounting the cover 60, first, the cover 60 is mounted from above at a position which is slightly shifted to the right side with respect to the carriage 50. In addition, the positioning convex portion 65*a* (refer to FIG. 3) is inserted into the positioning hole 55*a* when the cover 60 is moved to the left side with respect to the carriage 50 along the main scanning direction X intersecting the vertical direction Z. In addition, at the same time, units for locking 61*a*, 63*a*, and 62*b* on the cover 60 side are locked to cover locking units 52*a*, 54*a*, and 57*a* on the carriage 50 side.

FIG. 6(*b*) illustrates a state in which mounting of the cover 60 on the carriage 50 is completed. In this state, the pressing unit 62*c* of the cover 60 (refer to FIG. 4(*b*)) gently presses the connection unit 75 of the ink supplying tube 70 which is supported by the first guide unit 56 in the vertical direction Z. In addition, in this state, since a screw hole 58 which is formed in the carriage 50 and a through hole 64*a* of the cover 60 overlap with each other in the vertical direction Z (refer to FIG. 6(*a*)), it is possible to mount the cover 60 more strongly on the carriage 50 by screwing these together. On the other hand, it is also possible to detach the cover 60 from the carriage 50.

Subsequently, the ink supplying tube 70 which performs follow-up deformation with respect to the carriage 50 which performs reciprocating movement in a case of performing printing on a sheet P will be described.

Meanwhile, the multifunction peripheral 11 performs recording by ejecting ink to a sheet P which is transported in the forward-backward direction Y from the carriage 50 which performs reciprocating movement in the main scanning direction X. At this time, the ink supplying tube 70 which connects the adaptor 35 which is mounted on the carriage 50 and the ink tank 15 which is mounted on the outer side of the main body case 13 performs follow-up deformation along with the reciprocating movement of the carriage 50.

Figure 7:
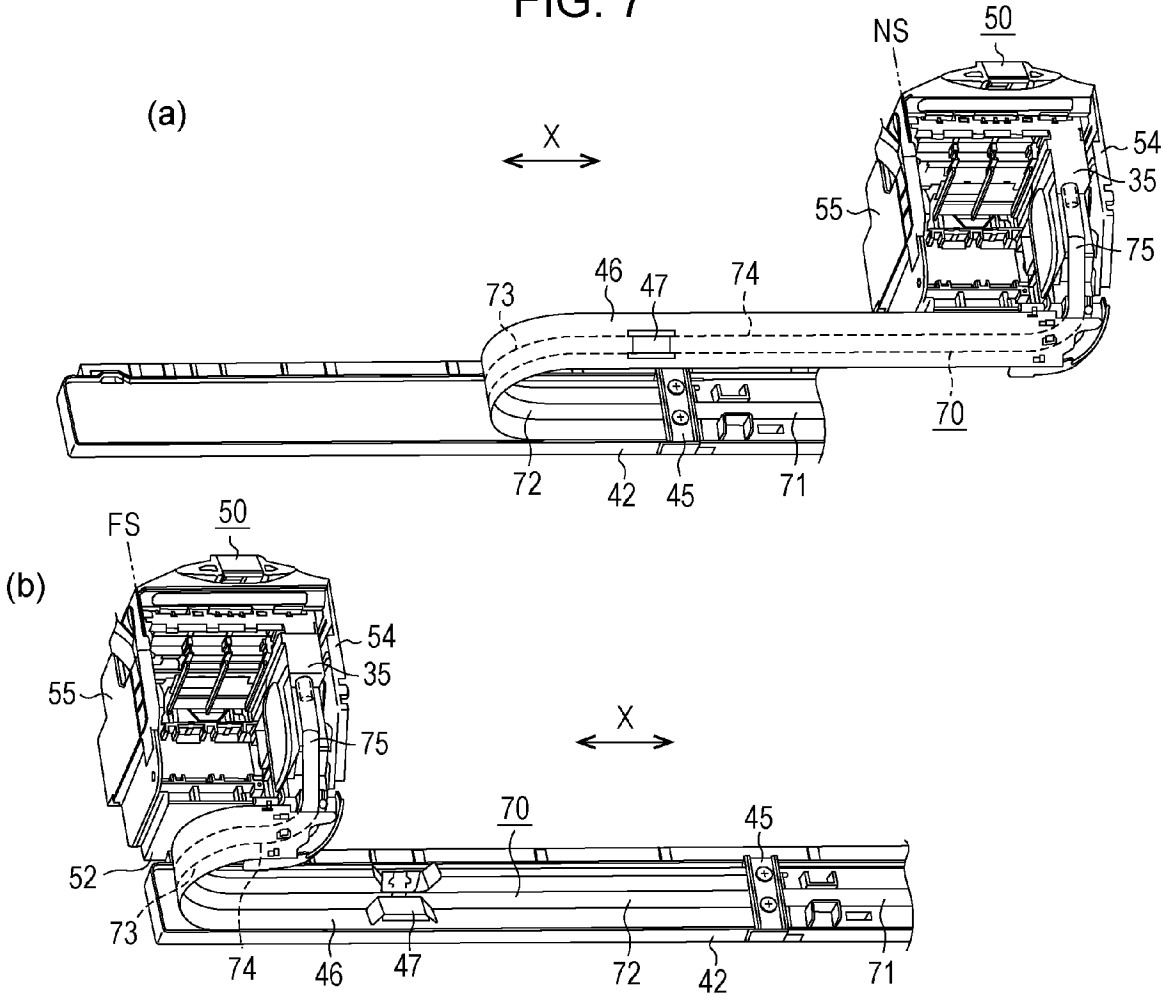
FIG. 7 is a diagram which illustrates a carriage which is reciprocating, FIG. 7(*a*) is a perspective view when the carriage is located at one end side of a movement region, and FIG. 7(*b*) is a perspective view when the carriage is located at the other end side of the movement region.

FIG. 7(*a*) illustrates a case in which the carriage 50 is located at a position which is closest to the ink tank 15 (refer to FIG. 5) NS. When the carriage 50 is located at the closest position NS in a range of the reciprocating movement thereof, the second extending portion 74 is in a state of being longer than the first extending portion 72 in the main scanning direction X, and the curved portion 73 is in a state of being located at approximately a center in a reciprocating movement range of the carriage 50.

On the other hand, FIG. 7(*b*) illustrates a case in which the carriage 50 is located at a position which is farthest from the ink tank 15 (refer to FIG. 5) FS in the reciprocating movement range. When the carriage 50 is located at the farthest position FS, the second extending portion 74 is in a state of being shortest in the main scanning direction X, and on the other hand, the first extending portion 72 is in a state of being longest. In addition, the curved portion 73 is in a state of being located at a position which is close to the farthest position MF side in the main scanning direction X. Here, in the main scanning direction X, the curved portion 73 is arranged between the third side wall 54 and the fourth side wall 55 of the carriage 50, and does not protrude toward the outside from the fourth side wall 55. Accordingly, even when the multifunction peripheral 11 repeatedly performs a reciprocating movement in the main scanning direction X in order to perform recording, the curved portion 73 (ink supplying tube 70) does not come into contact with an inner wall, or the like, of the main body case 13 on the farthest position FS Side. In this manner, it is possible for the ink supplying tube 70 to stably supply ink from the ink tank 15 to the adaptor 35.

According to the embodiment, it is possible to obtain the following effects.

(1) Since a space which is necessary for pulling around the ink supplying tube 70 in the main body case 13 of the multifunction peripheral 11 is sufficient for one ink supplying tube, it is possible to make the multifunction peripheral 11 compact in the forward-backward direction Y which is orthogonal to the movement direction of the carriage 50 compared to a case in which a plurality of ink supplying tubes 70 are pulled around in a state of being aligned side by side. Accordingly, it is possible to stably and continuously supply ink to the liquid ejecting head 34 through the ink supplying tube 70 which performs follow-up deformation along with the reciprocating movement of the carriage 50 while making the multifunction peripheral 11 compact.

(2) Since the second extending portion 74 is arranged so as to overlap with the first extending portion 72 in the vertical direction Z along with the reciprocating movement of the carriage 50, the ink supplying tube 70 can reliably make the apparatus main body compact in the forward-backward direction Y.

(3) When the carriage 50 is located at a position farthest from the ink tank 15 (farthest position FS) in the reciprocating movement range of the carriage 50, it is possible to cause the curved portion 73 of the ink supplying tube 70 not to protrude toward the outside from the fourth side wall 55 (end portion) in the main scanning direction X. In this manner, it is not necessary to secure a space for securing protrusion of the curved portion 73, and it is possible to make the multifunction peripheral 11 in the movement direction of the carriage 50 compact. Meanwhile, it is also possible to prevent the protrusion of the curved portion 73 from coming into contact with another structure in the main body case 13.

(4) By providing the protective plate 46, it is possible to prevent the ink supplying tube 70 which performs follow-up deformation along with the reciprocating movement of the carriage 50 from coming into contact with another member in the main body case 13.

(5) The regulation unit 47 of the protective plate 46 regulates a movement of the ink supplying tube 70 in a direction intersecting the extending direction of the ink supplying tube 70 which performs follow-up deformation along with the reciprocating movement of the carriage 50. In this manner, it is possible to prevent the ink supplying tube 70 from coming into contact with another member in the main body case 13 when moving in a direction intersecting the extending direction of the ink supplying tube 70.

(6) Since the ink supplying tube 70 is connected through the joint unit 43 in the main body case 13, it is possible to individually exchange the ink supplying tubes 70 on the upstream side and downstream side which are connected through the joint unit 43. In this manner, it is possible to improve maintainability related to an exchange of the ink supplying tube 70.

(7) It is possible to make a mounting failure of the cover 60 be easily recognized by a user who views the multifunction peripheral 11 from above in general, when the cover 60 can be mounted in a direction which goes along the main scanning direction X intersecting the vertical direction Z, compared to a case in which the cover is mounted from above in the vertical direction Z.

(8) When the cover 60 is mounted on the carriage 50, the pressing unit 62*c* of the cover 60 presses the connection unit 75 of the ink supplying tube 70, and regulates a movement thereof. Accordingly, for example, even when a force generated in the extending direction of the ink supplying tube 70 due to the follow-up deformation of the ink supplying tube 70 which is performed along with the reciprocating movement of the carriage 50 is received, it is possible to prevent the connection unit 75 of the ink supplying tube 70 from being pulled out from the connection tube portion 35*a* of the adaptor 35.

(9) Changing of extending direction in the ink supplying tube 70 from the first extending portion 72 to the downstream end of the connection unit 75 is limited to a reverse at an angle of 180° in the curved portion 73, and bending at an angle of 90° in the connection unit 75. Accordingly, it is possible to make an arrangement form of the ink supplying tube 70 simple, and to suppress a pressure loss which occurs when supplying ink, compared to a case in which the ink supplying tube 70 is arranged by being bent many times.

In addition, the embodiment may be modified as the following modification example. In addition, modification examples may be combined.

In the embodiment, the pressing unit 62*c* or the cover 60 may be omitted.

In the embodiment, the cover 60 may be mounted in a direction which goes along the forward-backward direction Y.

In the embodiment, a plurality of the regulation units 47 of the protective plate 46 may be provided, or the regulation unit 47 may be omitted.

In the embodiment, only a part of the first extending portion 72 and second extending portion 74 may overlap with each other in the vertical direction Z, or may not overlap with each other.

In the embodiment, the mounting unit 59 on which the adaptor 35 is mounted may be another mounting unit 59.

In the embodiment, only one mounting unit 59 may be provided.

In the embodiment, the ink tank 15 may be arranged on the left side of the main body case 13. However, in this case, it is preferable to change the mounting unit 59 on which the adaptor 35 is mounted, and pulling around of the ink supplying tube 70 according to the arrangement of the ink tank.

In the embodiment, the curved portion 73 (ink supplying tube 70) may come into contact with the inner wall, or the like, of the main body case 13 when the carriage 50 is located on the outside of the reciprocating movement region which is related to recording.

In the embodiment, the liquid ejecting apparatus may be a liquid ejecting apparatus which ejects or discharges liquid other than ink. In addition, as liquid which is discharged as a minute amount of liquid droplets from the liquid ejecting apparatus, there are a granular shape, a tear shape, and a thread shape leaving a trail. In addition, the liquid here may be a material which can be ejected from a liquid ejecting apparatus. For example, the material may be a material in a state of liquid phase, materials which flow such as a liquid body having high or low viscosity, a sol, gel water, and an inorganic solvent, an organic solvent, a liquid, a liquid resin, a liquid metal (metallic melt) other than that. In addition, the liquid includes materials in which particles of a functional material which is formed of a solid body such as a pigment or metal particles are melted, or diffused, or mixed into a solvent, not only liquid as a state of the material. As a representative example of the liquid, the ink, liquid crystal, or the like, can be exemplified as described in the above embodiments. Here, the ink includes general water-based ink and oil-based ink, and a variety of liquid compositions such as gel ink, hot-melt ink, or the like. As specific examples of the liquid ejecting apparatus, there is a liquid ejecting apparatus which ejects liquid including a material such as an electrode material, or a coloring material which is used when manufacturing, for example, a liquid crystal display, an EL (electroluminescence) display, a surface emission display, a color filter, or the like, in a form of dispersion or dissolution. As the liquid ejecting apparatus, there may be a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. In addition, the liquid ejecting apparatus may be a liquid ejecting apparatus which ejects a lubricant to a precision machine such as a clock, a camera, or the like, using a pinpoint, or a liquid ejecting apparatus which ejects transparent resin liquid such as a UV curable resin for forming a micro hemispherical lens (optical lens) which is used in an optical communication element, or the like, onto a substrate. In addition, the liquid ejecting apparatus may be a liquid ejecting apparatus which ejects etching liquid such as an acid or alkali for etching a substrate, or the like.

REFERENCE SIGNS LIST

11 MULTIFUNCTION PERIPHERAL
12 RECORDING APPARATUS (AN EXAMPLE OF LIQUID EJECTING APPARATUS)
15 INK TANK (AN EXAMPLE OF LIQUID TANK)
34 LIQUID EJECTING HEAD
35 ADAPTOR
35*a* CONNECTION TUBE UNIT (AN EXAMPLE OF CONNECTION PORTION)
43 JOINT UNIT (AN EXAMPLE OF JOINT)
46 PROTECTIVE PLATE
47 REGULATION UNIT
50 CARRIAGE
55 FOURTH SIDE WALL (AN EXAMPLE OF END PORTION)
59 MOUNTING UNIT
60 COVER
62*c* PRESSING UNIT
70 INK SUPPLYING TUBE (AN EXAMPLE OF LIQUID SUPPLY TUBE)
71 INTRODUCTION UNIT
72 FIRST EXTENDING PORTION
73 CURVED PORTION
74 SECOND EXTENDING PORTION
75 CONNECTION UNIT
P SHEET (AN EXAMPLE OF TARGET)
X MAIN SCANNING DIRECTION
Y FORWARD-BACKWARD DIRECTION
Z VERTICAL DIRECTION

The invention claimed is:

1. A liquid ejecting apparatus comprising:

a liquid ejecting head which can eject liquid onto a target;

a carriage which can perform a reciprocating movement in an apparatus main body in a state of having the liquid ejecting head installed thereon, and a relay adaptor which can supply the liquid to the liquid ejecting head;

an ink supply tube which is connected with the adaptor and which elastically deforms in response to the reciprocating movement of the carriage within the apparatus main body so as to supply the liquid from a liquid tank, located at an upstream side of the ink supplying tube and arranged outside of a movement range of the carriage, to the relay adaptor which is located at a downstream side of the ink supplying tube; and a protective plate which is additionally provided on the outer side of the liquid supply tube which performs follow-up deformation along with the reciprocating movement of the carriage together with the liquid supply tube, wherein the protective plate includes a regulation unit which regulates a movement of the liquid supply tube in a direction intersecting an extending direction of the liquid supply tube.

2. The liquid ejecting apparatus according to claim 1, wherein the liquid supply tube is configured to include a first extending portion which is in a state of extending along a movement direction of the carriage in the apparatus main body from the liquid tank side;

a curved portion which is in a curved state which is reversed in a vertical direction by being stretched out to the downstream side from the first extending portion;

a second extending portion which is in a state of extending along the movement direction of the carriage in the apparatus main body by being stretched out to the downstream side from the curved portion; and a connection unit which is connected to the adaptor by being stretched out to the downstream side from the second extending portion, and wherein the first extending portion and the second extending portion may be pulled around so that at least partial portions thereof overlap with each other in the vertical direction.

3. The liquid ejecting apparatus according to claim 1, wherein a plurality of liquid supply tubes are connected with each other through a joint which connects tubes therebetween.

4. The liquid ejecting apparatus according to claim 1, wherein the cover includes a pressing unit which presses a connection unit so that a movement of the connection unit is regulated when the cover is mounted on the carriage.

5. The liquid ejecting apparatus according to claim 1, wherein a home position is defined at which maintenance of the liquid ejecting head can be performed, and wherein the relay adaptor is located at or near an edge on a home position side in the carriage, and other areas in the carriage are spaces.

6. A liquid ejecting apparatus comprising:

a liquid ejecting head which can eject liquid onto a target;

a carriage which can perform a reciprocating movement in an apparatus main body in a state of having the liquid ejecting head installed thereon, and a relay adaptor which can supply the liquid to the liquid ejecting head; and an ink supply tube which is connected with the adaptor and which elastically deforms in response to the reciprocating movement of the carriage within the apparatus main body so as to supply the liquid from a liquid tank, located at an upstream side of the ink supply tube and arranged outside of a movement range of the carriage to the relay adaptor which is located at a downstream side of the ink supplying tube; and a cover which is mounted on the carriage from a direction intersecting a vertical direction in order to cover the adaptor which is installed on the carriage from above.

7. The liquid ejecting apparatus according to claim 6, wherein the liquid supply tube is configured to include:

a first extending portion which is in a state of extending along a movement direction of the carriage in the apparatus main body from the liquid tank side;

a curved portion which is in a curved state which is reversed in a vertical direction by being stretched out to the downstream side from the first extending portion;

a second extending portion which is in a state of extending along the movement direction of the carriage in the apparatus main body by being stretched out to the downstream side from the curved portion; and a connection unit which is connected to the relay adaptor by being stretched out to the downstream side from the second extending portion, and wherein the first extending portion and the second extending portion may be pulled around so that at least partial portions thereof overlap with each other in the vertical direction.

8. The liquid ejecting apparatus according to claim 6, wherein a connection portion of the relay adaptor to the liquid supply tube is installed at a position which is separated from an end portion of the carriage which is a side opposite to a side on which the liquid tank is arranged, in the movement direction of the carriage.

9. A liquid ejecting apparatus comprising:

a liquid ejecting head which can eject liquid onto a target;

a carriage which can perform a reciprocating movement in an apparatus main body in a state of having the liquid ejecting head installed thereon, and a relay adaptor which can supply the liquid to the liquid ejecting head; and one ink supply tube which is connected with the adaptor and which elastically deforms in response to the reciprocating movement of the carriage within the apparatus main body so as to supply the liquid from a liquid tank, located at an upstream side of the ink supply tube and arranged outside of a movement range of the carriage, to the relay adaptor which is located at a downstream side of the ink supplying tube; and wherein the relay adaptor is mounted so that a connection portion to the liquid supply tube is located by being separated from an end edge portion of the carriage which is a side opposite to a side on which the liquid tank is arranged in a movement direction of the carriage.

* * * * *